United States Patent [19]

Walters

[11] Patent Number: 4,928,415

[45] Date of Patent: May 29, 1990

[54] FOLDING SIGN

[76] Inventor: Dale E. Walters, 569 Monceau Dr., St. Louis, Mo. 63135

[21] Appl. No.: 366,511

[22] Filed: Jun. 14, 1989

[51] Int. Cl.[5] ..... G09F 15/00

[52] U.S. Cl. ..... 40/610; 40/612

[58] Field of Search ..... 40/610, 612, 616, 606

[56] References Cited

U.S. PATENT DOCUMENTS

| | | | |
|---|---|---|---|
| 549,630 | 11/1895 | Cole . | |
| 3,557,479 | 8/1968 | Allison et al. . | |
| 4,005,537 | 2/1977 | Von Camber et al. . | |
| 4,062,139 | 12/1977 | Klosel | 40/612 X |
| 4,071,969 | 2/1978 | Tonhauser . | |
| 4,226,040 | 10/1980 | Carroll et al. | 40/612 X |
| 4,279,105 | 7/1981 | Cameron . | |
| 4,462,145 | 7/1984 | Schulze | 40/610 X |
| 4,796,369 | 1/1989 | Hamann | 40/610 X |

FOREIGN PATENT DOCUMENTS

| | | | |
|---|---|---|---|
| 2086116 | 5/1982 | United Kingdom | 40/610 |
| 2186729 | 8/1987 | United Kingdom | 40/610 |

*Primary Examiner*—Laurie K. Cranmer

*Attorney, Agent, or Firm*—Kalish & Gilster

[57] ABSTRACT

An invertible, foldable sign formed of an integral blank synthetic resin material permits repeated folding and reversibility for display of multiple messages. The sign has opposite side panels joined by an integral resilient hinge, which panels are latchable into display configuration by integral tabs. The sign is self-latching for shipping or storage.

15 Claims, 1 Drawing Sheet

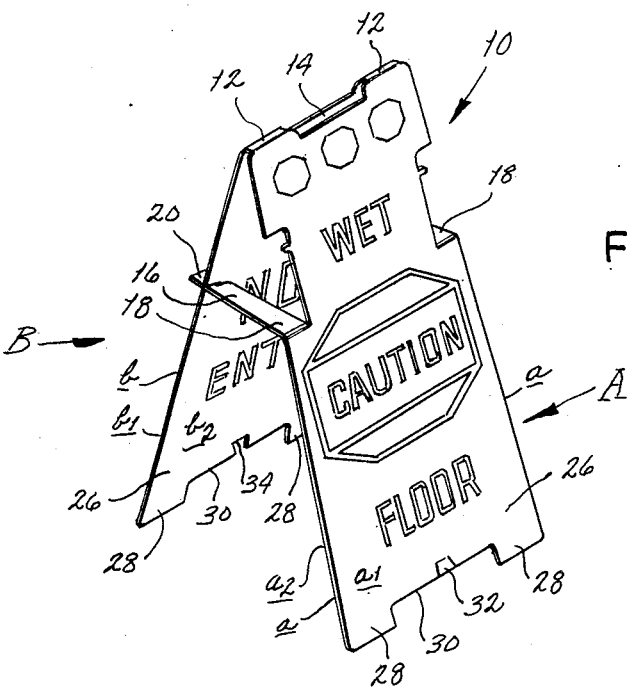
FIG. 1
FIG. 2
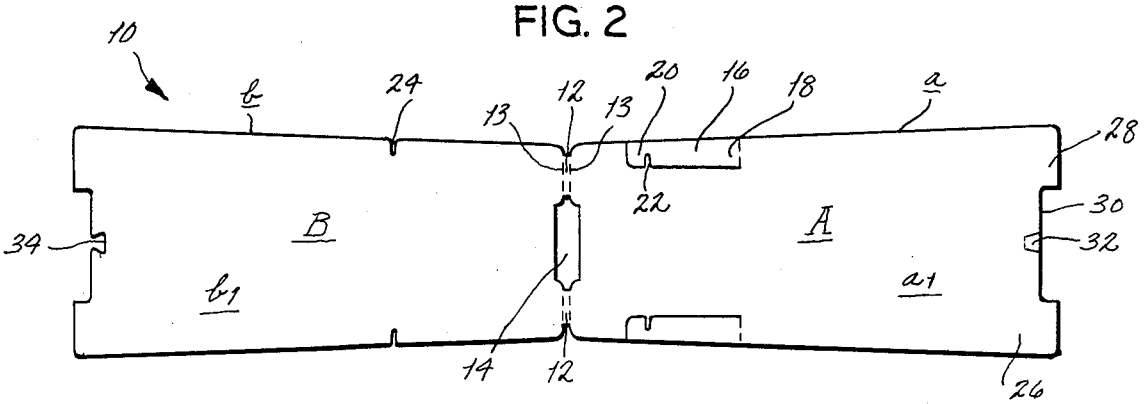
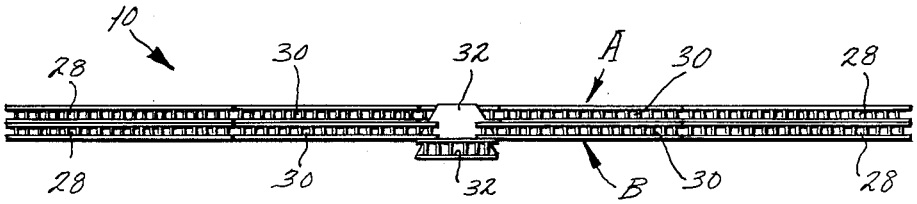
FIG. 3

FOLDING SIGN

BACKGROUND AND SUMMARY OF THE INVENTION

The present invention relates to signs and more particularly, to reversible foldable signs, being especially adapted for repeated use, for carrying multiple permanent messages and for efficient shipping and storage.

The idea of a folding sign has long been known. For example, Cole U.S. Pat. Ser. No. 549,630 discloses a wagon-carried sign which is mounted on a frame and foldable on itself for protection of the outer surface. More recent folding signs are disclosed in Allison et al U.S. Pat. Ser. No. 3,557,479 and Cameron U.S. Pat. Ser. No. 4,279,105. Allison et al discloses a road sign which is portable and folds in half upon itself, to conceal the message or display a different message on the sign back. Cameron also discloses a portable, foldable sign. Cole, Cameron and Allison et al require that hinges be attached to the sign elements to permit folding, and require provision of separate frame elements for supporting and/or transporting the sign.

Other types of sign support devices are known which allow folding or collapse for storage, but these do not necessarily include a sign which is itself foldable or reversible for showing multiple different messages. Examples of these devices are disclosed in Tonhauser U.S. Pat. Ser. No. 4,071,969 and von Camber et al U.S. Pat. Ser. No. 4,005,537.

Known signs exist in many styles but various disadvantages occur with each of them. If made of wood or metal, the sign is subject to corrosion or rattling and is heavy, making it expensive and difficult to transport. The usual requirement of a support base entails more weight to be shipped and handled for positioning the sign. It may also be awkward or cumbersome to store. An independent, supporting structure by definition means that there is at least one other part, other than the sign itself, which must be maintained in good condition and not lost.

To avoid the expense of metal or wood, signs may be made of paper or cardboard. These, however, will deteriorate very rapidly if allowed to come in contact with moisture of any kind, for example from rain, floor spills or cleaning solutions. Also, colors on paper-based signs will often fade after extended exposure to the sun.

Many signs are limited to displaying only one, or at the most, two messages. Furthermore, if a hinge element is required, to enable the sign to fold for storage or alternate message display, the hinge element is subject to sticking or breakage after exposure to the weather or repeated use.

Accordingly, it is among the several objects of this invention to provide a sign which is inexpensive, lightweight, and is resistant to most liquids, ultraviolet light and a wide range of temperatures. The sign should also be reversibly foldable for display of multiple messages and should withstand numerous repeated foldings upon an integral hinge. Further objects of the new sign are that it have no metal or wood latches or hinges, but rather that it be made of a polypropylene/ polyethylene material which will not deteriorate after long exposure to nearly any environment and that it have an integrally formed base latch to maintain the sides in a closely-folded position for shipping or storage, as well as integrally formed latches or braces which will hold the sign side panels in a non-slipping, upright display position.

Further, the proposed sign should be capable of being formed in a variety of colors, widths and heights, having no nails, screws or rivets to pull apart or break and should be of material which is non-conductive, anti-static and highly resistant to impact.

In furtherance of these objects, the sign of the present invention is briefly, a durable, invertible, foldable, self-supporting sign formed of a single flat corrugated synthetic resin material board blank. The blank comprises two rigid trapezoidal-shaped side panels. Each side panel has two flat surfaces for displaying visual messages. When the sign is erect, the two side panels share an upper edge which comprises a common integral resilient hinge for permanently reversibly attaching the side panels. The side panels also have base portions, for contact with the floor or ground and support of the sign. The side panels further have outer edges which form a substantially triangular shape with the line of the ground or floor surface when viewed from either side of the sign.

The above listed features permit upright, durable, selective display of multiple different messages on the reverse sides of the sign and permit selective opened-flat or folded-flat shipping and storage of the sign.

Other objects and features will be in part apparent and in part pointed out hereinbelow.

BRIEF DESCRIPTION OF THE DRAWINGS

FIG. 1 a perspective view of the sign constructed in accordance with and embodying the present invention in an upright, braced position.

FIG. 2 plan view of a blank for the sign of FIG. 1 in an opened-flat position.

FIG. 3 is a base-end view of the sign of FIG. 1 in a folded-flat, latched position.

DESCRIPTION OF THE PREFERRED EMBODIMENT

A foldable sign of the present invention, generally designated 10, is preferably formed in one piece of a blank (shown in FIG. 2) and cut from a lightweight, waterproof, sunproof corrugated polypropylene/-polyethylene copolymeric material (as illustrated in FIG. 3), such as that available under the trade designation COROPLAST, which is stiffly resilient, allowing repeated flexing of bendable portions for an indefinitely long, seemingly infinite lifetime. Alternatively, the material of sign 10 may be non-corrugated or of other synthetic resin material. The sign material is resistant to harsh chemicals, such as are used in cleaning solutions, as well as to acid rain, and may be brightly colored for maximum visibility.

Sign 10 is divided in half, forming two side panels A and B, along an imaginary line perpendicular to the lengthwise axis of its blank, by a line of weakness, actually two closely spaced parallel lines of indentation 13, as impressed in the material during formation, which form resilient, springy sign hinges 12, which are indefinitely bendable. Hinges 12 are preferably formed with a space 14 between them so that the hinges appear shoulder-like at the upper end of erected sign 10 (shown in FIG. 1).

Placement of hinges 12 at a point midway along the length of the blank results in sign outer edges a and b forming an isosceles triangle with the floor surface or ground upon which sign 10 is erected. Sign 10 side panels A and B each have two flat surfaces $a_1$, $a_2$, and $b_1$, $b_2$ and preferably appear trapezoidally shaped when viewed from the front, as in FIG. 1. Each of the sign panel surfaces may carry a printed message, with preferably different messages on $a_1$, $a_2$ than on $b_1$, bhd 2, or alternatively, different messages on each of the four surfaces for increased utility.

Sign side A has formed along each of its outer edges a, at least one lengthwise tab 16 which can be pressingly and partially separated from its respective side a. Tab 16 remains resiliently attached to its side a at one of its ends 18 and carries on its inner other end 20 a notch 22. Sign side B has formed along each of its outer edges b, at least one notch 24 which is located approximately horizontally from tab end 18 when sign 10 is erect. Notch 24 interlocks with notch 22 in tab 16 and such relationship is maintained by the resilience of tab 16, such that tab 16 acts as a brace to maintain sign 10 in its erect position (FIG. 1).

Sign 10 has a base portion 26 at the outermost end of each of its sides A and B. Base portion 26 is preferably formed having two legs 28 extending from the base lower edge 30.

Base portion lower edge 30 of side A preferably carries an integrally formed, centrally located, substantially triangular-shaped tab 32, having its widest portion along edge 30 and its narrowest portion flexibly attached above edge 30 to side A.

Base portion lower edge 30 of side B preferably carries an integrally formed, centrally located substantially triangular notch 34, having its narrowest portion along base edge 30 and its widest portion above base edge 30. Base tab 32 fits resiliently and interlockingly into base notch 34 to quickly and simply latch base portions 26 of sides A and B together, for shipping or storage in a folded flat position. This mechanism is illustrated in FIG. 3, which also shows the corrugated nature of the material. The lines of corrugations of the polymeric blank material run lengthwise of the blank, i.e., in the direction from one panel base portion to the other panel base portion.

Accordingly, it is seen that there is provided a durable, invertible, foldable self-supporting sign formed of a single synthetic resin material board blank, comprising two stiffly resilient side panels, each side panel having two flat surfaces for display of visual messages. When erected, said side panels have an upper edge comprising a common integral resilient hinge for permanently reversibly attaching said side panels. Said side panels further have base portions for contacting a ground or floor surface and supporting the erected sign. When in use, upright durable selective display of multiple different messages is permitted on the reverse sides of the sign. For shipping or storing, the sign can be either opened-flat or folded-flat.

Further, it will be seen that in forming the foldable self-supporting sign of the invention, a blank of stiffly resilient synthetic resin material is used. This blank is comprised of a single board defining two panels joined in a central region, the outer ends of the panels providing a floor or ground contact surface and the side edges of the blanks extending between two opposite ends. At least one line of weakness extends transversely of the central region to provide hinge-forming inner ends of the panels for folding of the blank along such line of weakness for defining a resilient hinge between the panels. The panels thus extend in opposite directions from the hinge with said outer ends of the panels in contact with the floor or ground, and tab means are provided along at least one edge of one of the panels for interengaging the other of the panels for maintaining the two panels in a folded relationship.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A durable, invertible, self-supporting sign formed of a single synthetic resin material board blank, comprising two stiffly resilient side panels, each side-panel having two flat surfaces for display of visual messages, said side panels when erected having an upper edge comprising a common integral resilient hinge for permanently reversibly interengaging said side panels, said side panels further having base portions for contacting a ground or floor surface and supporting the erected sign, said base portions forming legs located at each lower corner of the base portions for supporting the sign and raising it from the ground or floor surface, whereby to permit upright durable selective display of multiple different messages on the reverse sides of the sign and to permit selectively opened-flat or folded-flat shipping and storage of said sign.

2. A self-supporting sign as set forth in claim 1 wherein said side panels are of equal length, such that the edges of the erected sign side panels, when viewed from the side, form an isosceles triangle with the line of the ground or floor surface support and each of said sign side panel flat surfaces is trapezoidal when viewed from the front.

3. A self-supporting sign as set forth in claim 1 wherein said integral hinge comprises double lines of indentation impressed during formation upon both sides of said blank at a position substantially midway between and substantially parallel to the base portions of each side panel, for ease of folding and maintenance of the folded sign position.

4. A self-supporting sign as set forth in claim 1 wherein said integral hinge comprises at least two tab-type hinges separated by a space, for ease of folding and providing a shouldered appearance to the sign.

5. A self-supporting sign as set forth in claim 1 wherein said side panel base portions comprise substantially triangular corresponding tab and slot structures for selectively interlocking and maintaining the side panels in a flat-folded position for storage or shipping.

6. A self-supporting sign as set forth in claim 1 wherein one side panel carries integrally formed lengthwise tabs on each of its outer edges and the other side panel carries integrally formed notches on each of its outer edges, the lengthwise tabs each being bendably attached to its respective panel at one end and having a notch in its other end inner edge corresponding to said notch in the opposite side panel outer edge, for interlocking to maintain the sign independently in either of its reversible upright display positions.

7. A self-supporting sign as set forth in claim 1 wherein said synthetic resin material comprises a copolymeric polypropylene/polyethylene corrugated board material.

8. A self-supporting sign as set forth in claim 7 wherein said corrugated board material has lines of corrugation running lengthwise of the blank in the direction from one panel base portion to the other base portion.

9. For use in forming a foldable self-supporting sign, a blank of stiffy resilient synthetic resin material comprised of a single board defining two panels joined in a central region, the outer ends of the panels providing a floor or ground contact surface, said outer ends forming legs located at each lower corner of the outer ends for supporting the sign and raising it from the ground or floor the side edges of the blanks extending between two opposite ends, at least one line of weakness extending transversely of the central region to provide hinge-forming inner ends of the panels for folding of the blank along such line of weakness for defining a resilient hinge between the panels with the panels extending in opposite directions from the hinge with said outer ends of the panels in contact with the floor or ground, and tab means provided along at least one edge of one of the panels for interengaging the other of the panels for maintaining the two panels in folded relationship.

10. For use in forming a foldable self-supporting sign according to claim 9, said blank being of copolymeric polypropylene/polyethylene corrugated board material.

11. For use in forming a foldable self-supporting sign according to claim 9 wherein the side edges of the panels are rectilinear, the central region being narrower than the width of the blank at said outer ends of the panels, whereby each of the panels is trapezoidally shaped.

12. For use in forming a foldable self-supporting sign according to claim 9 wherein said tab means comprises means for retention of said sign side panels in an upright display position.

13. For use in forming a foldable self-supporting sign according to claim 9 wherein said tab means comprises means for retention of said sign side panels in a flat-folded position for shipping or storage.

14. For use in forming a foldable self-supporting sign according to claim 9 wherein said line of weakness comprises double, closely spaced indentations impressed in said synthetic material.

15. A durable, invertible, self-supporting sign formed of a single synthetic resin material board blank, comprising two stiffly resilient side panels, each side-panel having two flat surfaces for display of visual messages, said side panels when erected having an upper edge comprising a common integral resilient hinge for permanently reversibly interengaging said side panels, one side panel, carrying integrally formed lengthwise tabs on each of its outer side edges and the other side panel carrying integrally formed notches on each of its outer side edges, the lengthwise tabs each being bendably attached to its respective panel at one end and having a notch in its other end inner edge corresponding to said notch and the opposite side panel outer edge, for interlocking to maintain the sign independently in either of its reversible upright display positions, said side panels further having base portions for contacting a ground or floor surface and supporting the erected sign, whereby to permit upright durable selective display of multiple different messages on the reverse sides of the sign and to permit selectively opened-flat or folded-flat shipping and storage of said sign.

* * * * *

UNITED STATES PATENT AND TRADEMARK OFFICE

CERTIFICATE OF CORRECTION

PATENT NO. : 4,928,415

DATED : May 29, 1990

INVENTOR(S) : Dale E. Walters

It is certified that error appears in the above-identified patent and that said Letters Patent is hereby corrected as shown below:

Col. 5, line 15, after "floor" insert --,--.

Col. 6, line 20, after "panel" delete --,--.

Signed and Sealed this

Nineteenth Day of November, 1991

*Attest:*

HARRY F. MANBECK, JR.

*Attesting Officer*

*Commissioner of Patents and Trademarks*